US005303006A

United States Patent [19]

Mizude

[11] Patent Number: 5,303,006

[45] Date of Patent: Apr. 12, 1994

[54] IMAGE DENSITY CONTROL DEVICE FOR USE IN AN IMAGE FORMING APPARATUS

[75] Inventor: Kazuhiro Mizude, Osaka, Japan

[73] Assignee: Mita Industrial Co., Ltd., Osaka, Japan

[21] Appl. No.: 809,657

[22] Filed: Dec. 18, 1991

[30] Foreign Application Priority Data

Dec. 25, 1990 [JP] Japan ..... 2-406099
Dec. 25, 1990 [JP] Japan ..... 2-406100

[51] Int. Cl.[5] ..... G03G 21/00

[52] U.S. Cl. ..... 355/208; 355/219; 355/228; 355/246

[58] Field of Search ..... 355/208, 246, 219, 221, 355/220, 228, 229, 67, 69

[56] References Cited

U.S. PATENT DOCUMENTS

| | | | |
|---|---|---|---|
| 4,352,553 | 10/1982 | Hirahara | 355/208 |
| 4,796,060 | 1/1989 | Mizude . | |
| 4,816,871 | 3/1989 | Oushiden et al. . | |
| 4,872,035 | 10/1989 | Miyake et al. | 355/208 |
| 4,879,576 | 11/1989 | Naito | 355/228 X |
| 4,910,554 | 3/1990 | Noda | 355/208 |
| 5,006,896 | 4/1991 | Koichi et al. | 355/246 |
| 5,072,258 | 12/1991 | Harada | 355/208 |
| 5,214,474 | 5/1993 | Ishizuka | 355/208 X |

FOREIGN PATENT DOCUMENTS

| | | |
|---|---|---|
| 2607943 | 6/1988 | France . |
| 60-119580 | 6/1985 | Japan . |

OTHER PUBLICATIONS

Patent Abstracts of Japan, vol. 7, No. 176 (P-214) (1321) Aug. 4, 1983 and JP-A-58 079 264 (Canon K.K.).

Patent Abstracts of Japan, vol. 8, No. 72 (P-264) (1509) Apr. 4, 1984 and JP-A-58 217 950 (Matsushita).

Patent Abstracts of Japan, vol. 9, No. 167 (P-372) (1890) Jul. 12, 1985 and JP-A-60 043 669 (Matsushita).

*Primary Examiner*—A. T. Grimley
*Assistant Examiner*—Shuk Y. Lee
*Attorney, Agent, or Firm*—Jordan and Hamburg

[57] ABSTRACT

An image density control device is for use in an image forming apparatus having an exposure lamp for emitting light to illuminate a document, a photoreceptor for receiving light reflected from the document to produce an electrostatic latent image, and a charger for charging the photoreceptor. The image density control device includes a detector for detecting the density of the document, a light emission amount controller responsive to the detector for holding an amount of light emitted from the exposure lamp at a predetermined fixed value when the document density lies in a predetermined range, and surface potential controller responsive to the detector means for controlling the charger to change the surface potential of the photoreceptor in accordance with a change in the document density when the document density lies in the predetermined range. The predetermined range may be a range defined by a minimum document density and a reference document density, or the one defined by another reference document density and a maximum document density. In the former case, the surface potential is increased in accordance with a decrease in the document density when the document density lies in the predetermined range. In the latter case, the surface potential is decreased in accordance with an increase in the document density when the document density lies in the predetermined range.

7 Claims, 4 Drawing Sheets

IMAGE DENSITY CONTROL DEVICE FOR USE IN AN IMAGE FORMING APPARATUS

BACKGROUND OF THE INVENTION AND PRIOR ART STATEMENT

This invention relates to an image density control device for controlling the density of an image formed on copy paper in a copying machine or like image forming apparatus.

Conventionally, an image density control device for use in an image forming apparatus such as a copying machine has been designed to control the density of an image formed on copy paper (hereinafter referred to as image density throughout the Specification) by changing an amount of light emitted from a lamp to be projected onto a document while maintaining the surface potential of a photosensitive drum at a fixed level.

For example, in a copying machine provided with an automatic exposing device of the prescanning type, a predetermined amount of light is emitted from a lamp and projected onto a document, and a prescanning operation is executed while the light reflected by the document is being detected by a photodetector. The density of the document (document density) is calculated on the basis of the amount of light detected in the prescanning. Based on the calculated document density, an amount of light to be emitted from the lamp is determined in a main scanning operation wherein copying of an image is actually executed.

Further, when the image density is manually adjusted, for example, the light emission amount of the lamp is determined according to the document density set by manipulating a density setting key with the use of a conversion table in which the relationship between the document density and the light emission amount of the lamp is predefined.

FIG. 5 is a graph showing a conventional relationship between the document density and the light emission amount of the lamp, according to which the light emission amount is determined based on the document density. In FIG. 5, indicated at A, B, C are reference document densities corresponding to reference documents G1, G2, G3. For instance, when the detected or set document density is substantially equal to that of the reference document densities A, B, or C, light emission amount of the lamp is a, b, or c.

In a conventional image density control device, the lamp emits less of light as the document density becomes lower. Accordingly, when an image of a document whose density is lower than the density B is to be copied, there is a likelihood that the amount of light emitted from the lamp is too small relative to the actual density of the document, thereby causing the fog on the copy to have higher density than necessary. Hereinafter, the density of the fog is referred to as fog density. In other words, a white area in the document is formed into a grey area in the copy. In order to prevent the fog density from increasing to an unnecessarily high level, it may be considered that the relationship between the document density and the light emission amount is defined in such a fashion as to make the inclination of the curve in the graph of FIG. 5 smoother below the density B. Thereby, the light emission amount of the lamp can be adjusted to be larger than the conventional light emission amount in the case where the document density is relatively low. However, in this case, the following problem occurs. If the density of a document image is low, the resulting image density is low as a whole, thereby forming an unclear image. This is especially prominent if the document image consists of characters, or a diagram.

On the other hand, when an image of a document whose density is higher than the density C of the reference document G3 is to be copied, the light emission amount of the lamp is c, which corresponds to the reference document G3. Similar to the foregoing case, there is a likelihood that the fog density increases to a higher level than necessary due to deficiency in light emission amount. In order to avoid this problem, the use a lamp capable of emitting a larger amount of light may be considered. However, this results in increased costs and an increase in the temperature of a scan/exposure system due to the heat generated from the lamp, thereby necessitating implementation of some measures against the generated heat.

SUMMARY OF THE INVENTION

It is an object of the present invention to provide an image density control device for use in an image forming apparatus which has overcome the problems as set forth above.

Accordingly, the invention is directed to an image density control device for use in an image forming apparatus having an exposure lamp for emitting light to illuminate a document, a photoreceptor for receiving light reflected from the document to produce an electrostatic latent image, and a charger for charging the photoreceptor, the device comprising detector means for detecting the document density, light emission amount controlling means responsive to the detector means for holding an amount of light emitted from the exposure lamp at a predetermined fixed value when the document density lies in a predetermined range, and surface potential controlling means responsive to the detector means for controlling the charger to change the surface potential of the photoreceptor in accordance with a change in the document density when the document density lies in the predetermined range.

With the image density control device thus constructed, when the document density lies in a predetermined range, the light emission amount is held at a predetermined fixed value and the surface potential is changed in accordance with a change in the document density. Accordingly, the image density can be controlled with higher precision.

The predetermined range may be a range defined by a minimum document density and a predetermined reference value, and the surface potential controlling means controls the charger to increase the surface potential in accordance with a decrease in the document density when the document density lies in the predetermined range.

With the image density control device thus constructed, in the case where the detected document density lies in the predetermined range, the light emission amount of the exposure lamp is set at the predetermined fixed value while the surface potential of the photoreceptor is set at a higher value as the document density becomes lower. Accordingly, even in the case where the base color of the document is white and the density of the document image is low, there can be prevented an occurrence in which the fog density increases to such an extent as to make the copied document image unclear. Thus, it can be assured to obtain a copy of a suitable image density.

Further, the predetermined range may a range defined by a predetermined reference document density and a maximum document density, and the surface potential controlling means controls the charger to decrease the surface potential in accordance with an increase in the document density when the document density lies in the predetermined range.

With this arrangement, when the detected document density lies in the predetermined range, the light emission amount of the exposure lamp is set at the predetermined fixed value while the surface potential of the photoreceptor is set at a lower value as the document density becomes higher. Accordingly, even in the case where a document to be copied has such density as to require more light than the exposure lamp can emit, there can be prevented an occurrence in which the fog density increases to a high level due to deficiency in the light emission amount of the lamp. Thus, it can be assured that a copy of a suitable image density is obtained.

Moreover, the predetermined range may include a first subrange defined by a minimum document density and a first predetermined reference document density and a second subrange defined by a second predetermined reference document density and a maximum document density. When the document density lies in the first subrange, the light emission amount controlling means sets the light emission amount at a first predetermined fixed value while the surface potential controlling means controls the charger to increase the surface potential in accordance with a decrease in the document density. On the other hand, when the document density lies in the second subrange, the light emission amount controlling means sets the light emission amount at a second predetermined fixed value while the surface potential controlling means controls the charger to decrease the surface potential in accordance with an increase in the document density in the second subrange.

With this arrangement, when the detected document density lies in the first subrange, the light emission amount of the exposure lamp is set at the first predetermined fixed value while the surface potential of the photoreceptor is set at a higher value as the document density becomes lower. Accordingly, even when the base color of the document is white and the density of the document image is low, an occurrence in which the fog density increases to such an extent as to make the copied document image unclear can be prevented. On the other hand, when the detected document density lies in the second subrange, the light emission amount of the exposure lamp is set at the second predetermined value and the surface potential of the photoreceptor is set at a higher value as the document density becomes lower. Accordingly, even when a document to be copied has such density as to require more light than the exposure lamp can emit, an occurrence in which the fog density increases to a high level due to deficiency in the light emission amount of the lamp can be prevented. Thus, it can be assured to obtain a copy of a suitable image density.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 2:
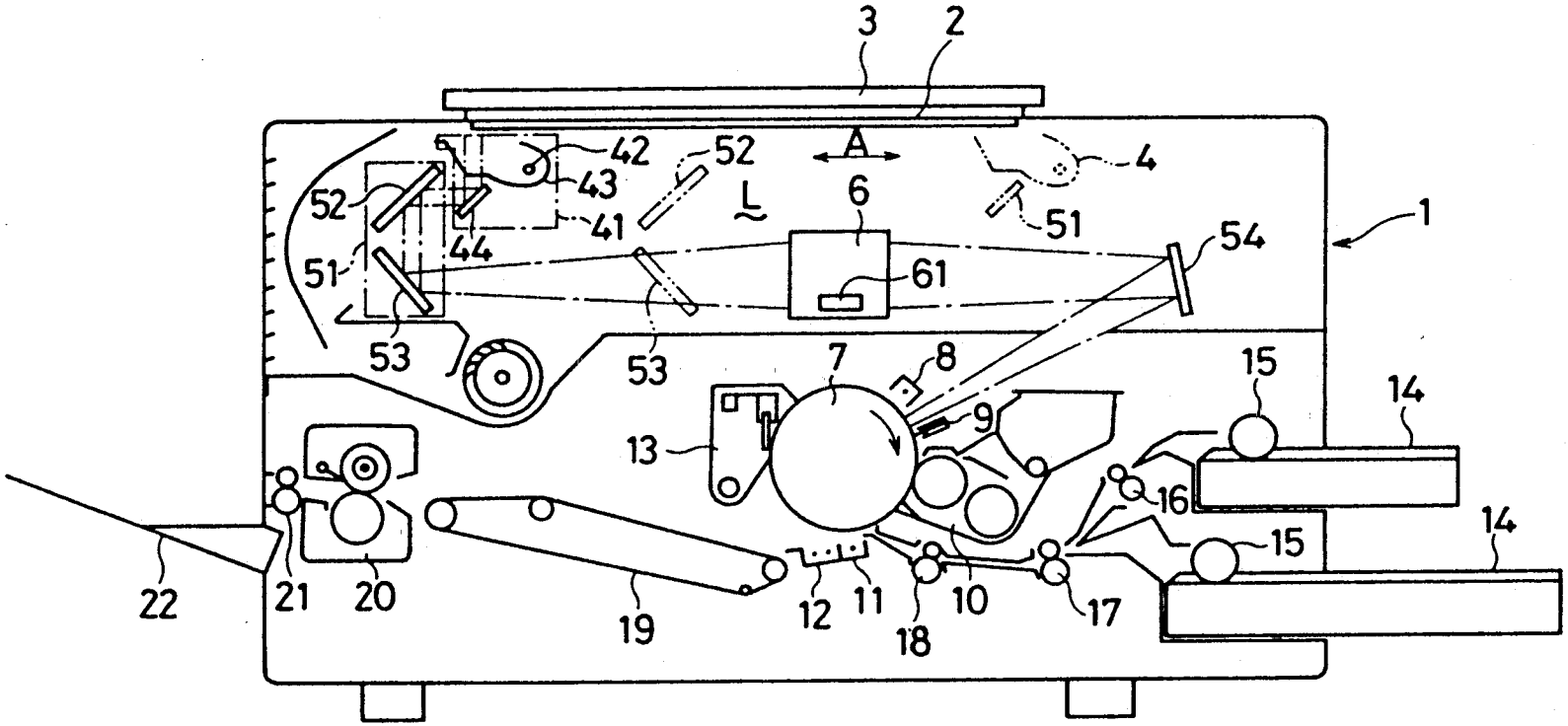
FIG. 2 is a front view in section showing an overall construction of an image forming apparatus provided with the image density control device.

FIG. 2 is a diagram showing an overall construction of an image forming apparatus provided with an image density control device embodying the invention.

A scan/exposure system L comprises a lamp 42 consisting of a halogen lamp for projecting the light onto a document, and an optical system having a reflector 43, mirrors 44, 52 to 54, and a lens 6. The optical system is adapted for introducing a document image to a photosensitive drum 7 disposed therebelow. The lens 6 carries a photodetector 61 for detecting the light reflected by the document.

The lamp 42, reflector 43, and mirror 44 are included in a first moving frame body 41 while the mirrors 52, 53 are included in a second moving frame body 51. These first and second moving frame bodies 41, 51 are movable reciprocatingly in a horizontal direction (in directions indicated by arrows A) below a platen glass 2.

The scan/exposure system L illuminates the document placed on the platen glass 2 in the form of a slit at a specified intensity while causing the first and second moving frame bodies 41, 51 to move reciprocatingly between a position corresponding to a leading end of the document and a position corresponding to a trailing end thereof. In this way, the document image is introduced to the photosensitive drum 7, whereupon an exposure is executed.

Around the photosensitive drum 7 are disposed a main charger 8, a blank lamp 9, a developing device 10, a transfer charger 11, a separation charger 12, a cleaning device 13, etc. The main charger 8 sets a surface potential of the drum 7. The blank lamp 9 removes charges in a region of the surface of the drum 7 which are not to be used in an image forming operation. The developing device 10 develops a latent image formed on the surface of the drum 7 into a toner image. The transfer charger 11 transfers the developed document image to copy paper. The separation charger 12 separates the copy paper having the document image transferred thereto from the surface of the drum 7. The cleaning device 13 removes the toner residual on the surface of the drum 7. The drum 7 and the peripheral devices thereof constitutes an image forming station.

To one side surface (right side surface in FIG. 2) of the copying machine 1 copy paper cassettes 14 are removably mounted. The copying machine 1 is internally provided with a copy paper feeding station, which is disposed between the cassettes 14 and the photosensitive drum 7. The copy paper feeding station comprises feed rollers 15, pairs of transport rollers 16, 17, and a pair of register rollers 18. Each feed roller 15 dispenses a sheet of copy paper from the cassette 14. The pairs of transport rollers 16, 17 transport the copy paper sheet to the pair of register rollers 18, which in turn feed the copy paper sheet transported thereto to the drum 7 at a specified feed timing so that the feed of the copy paper sheet will synchronize with the scan of the scan/exposure system L.

On the other side (left side in FIG. 2) of the copying machine 1 a discharge tray 22 is disposed onto which the copy paper sheet having the document image copied thereon is discharged. A fixing/discharging station is provided between the photosensitive drum 7 and the discharge tray 22 in the copying machine 1. The fixing-/discharging station comprises a transport belt 19, a fixing device 20, and a pair of discharge rollers 21. The transport belt transports the copy paper sheet having the document image transferred thereto to the fixing device 20. The fixing device 20 fixes the transferred document image onto the copy paper sheet. The pair of discharge rollers 21 discharges the copy paper sheet onto the discharge tray 22.

Figure 1:
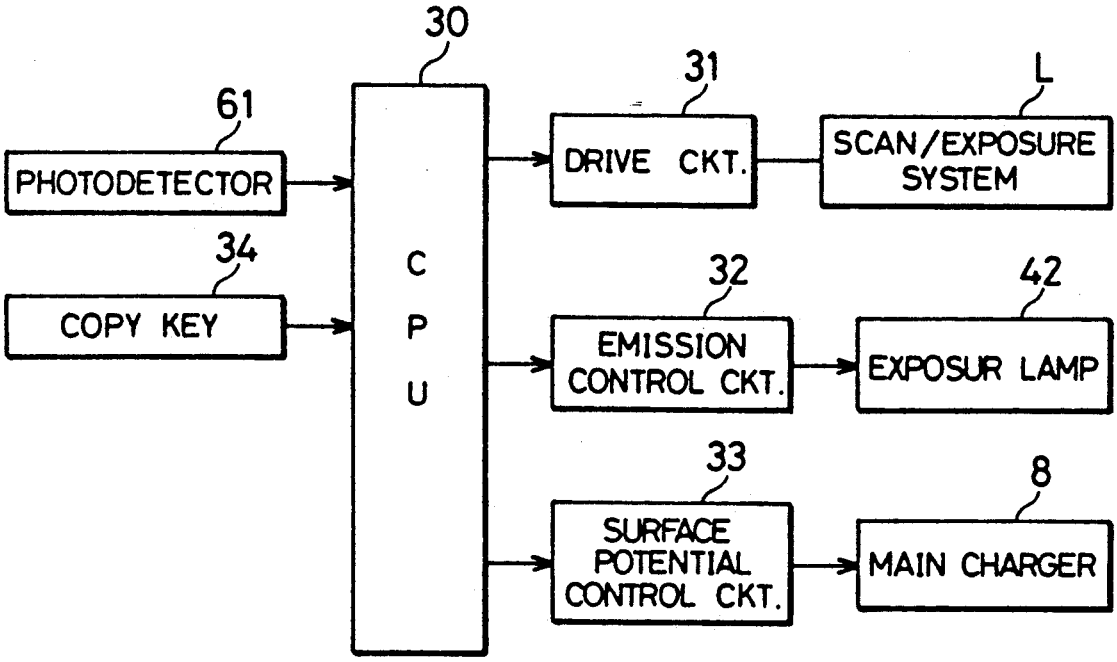
FIG. 1 is a block diagram showing an image density control device for use in an image forming apparatus embodying the invention.

FIG. 1 is a block diagram showing a construction of the image density control device embodying the invention.

In FIG. 1, indicated at 30 is a central processing unit (hereinafter referred to as CPU), at 31 an optical system drive circuit, at 32 an emission control circuit, at 33 a surface potential control circuit, and at 34 a copy key. The CPU 30 centrally controls the image forming operation of the copying machine 1. The drive circuit 31 controls the scan/exposure system L to drive the first and second moving frame bodies 41, 51. The emission control circuit 32 controls the emission of the lamp 42. The surface potential control circuit 33 controls the surface potential of the photosensitive drum 7. The copy key 34 is manipulated to instruct the image forming operation.

When the copy key being manipulated to instruct the image forming operation, the CPU 30 sends to the drive circuit 31 a control signal for the prescanning operation so as to cause the first and second moving frame bodies 41, 51 to move a predetermined amount. In addition, the CPU 30 sends to the emission control circuit 32 a control signal for the emission so as to cause the lamp 42 to emit a predetermined amount of light. In the prescanning operation, the light reflected by the document is detected by the photodetector 61 which in turn sends to the CPU 30 a sensor signal indicative of the level of detected reflection light. Upon receipt of the sensor signal from the photodetector 61, the CPU 30 determines the document density on the basis of the detected level of reflection light. The light emission amount of the lamp 42 and the surface potential of the drum 7 for a main scanning operation are determined based on the calculated document density.

Since the predetermined amount of light is emitted from the lamp 42 in the prescanning operation, the level of reflection light obtained by the photodetector 61 corresponds to the density of the document prescanned. More specifically, when the document density is low, i.e., the document as a whole is relatively white, the level of reflection light is high. On the other hand, when the document density is high, i.e., the document as a whole is relatively high, the level of reflection light is low. In this way, the document density is determined on the basis of the corresponding level of reflection light. Further, the light emission amount of the lamp 42 and the surface potential of the drum 7 in the main scanning operation are calculated based on relationship between the document density and the light emission amount, and that between the document density and the surface potential respectively. Description will be made on these relationships later.

It should be understood that the document density may be determined, and the light emission amount of the lamp 42 and the surface potential of the drum 7 may be calculated by way of conversion tables prestored in the CPU 30.

In an image forming operation, the surface potential of the drum 7 is set at the calculated surface potential, and the lamp 42 is caused to emit the calculated amount of light, whereupon the document is exposed.

Figure 3:
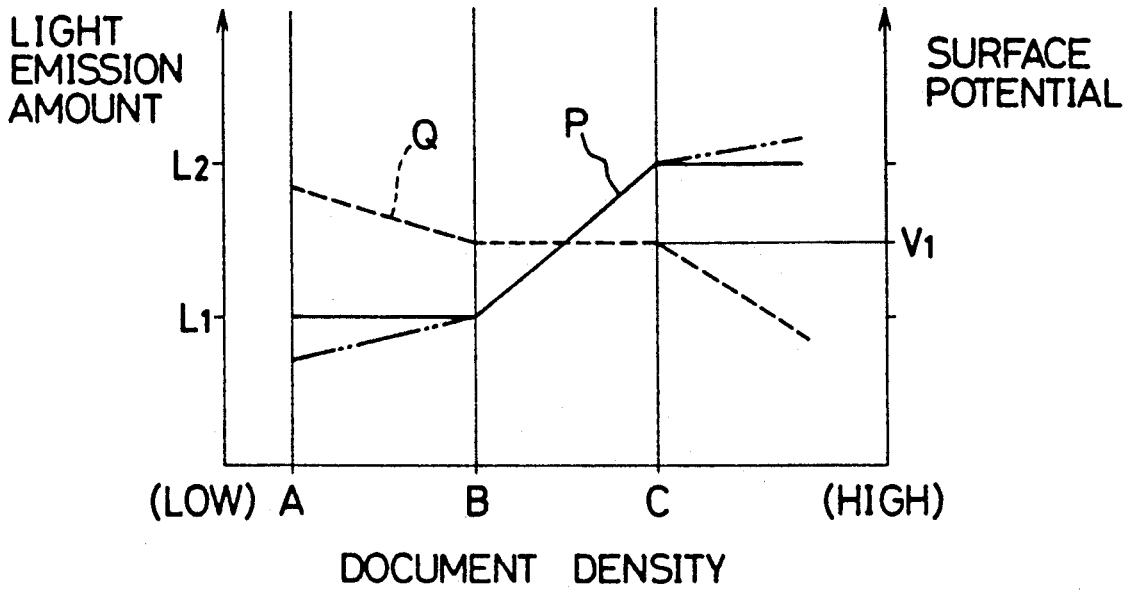
FIG. 3 is a graph showing the relationship between the document density and light emission amount of a lamp and relationship between the document density and the surface potential of a photosensitive drum.

FIG. 3 graphically shows the relationship between the document density and the light emission amount, and that between the document density and the surface potential used to obtain the light emission amount of the lamp 42 and the surface potential of the photosensitive drum 7 in the main scanning operation.

In FIG. 3, indicated at A, B, C are document densities of reference documents G1, G2, G3 respectively. The reference document G1 is, for example, a blank document having a specified brightness. The reference document G2 is, for example, a document having a brightness similar to the reference document G1 in which characters are typed at a specified density on the reference document G1. The reference document G3 is, for example, a document of a specified brightness whose base color is gray and in which characters are typed at a specified density. The reference document G3 corresponds to a standard newspaper sheet. In the graph of FIG. 3, a horizontal axis represents the document density. The document density becomes higher at a right side than at a left side along the horizontal axis. A curve P represents the relationship between the document density and the light emission amount of the lamp 42, whereas a curve Q represents the relationship between the document density and the surface potential of the drum 7.

As will be seen from FIG. 3, the light emission amount of the lamp 42 is set at a fixed value L1 when the document density is not higher than that of the reference document G2 (density B or lower). The limit emission amount of the lamp 42 is set at a fixed value L2 when the document density is not lower than that of the reference document G3 (density C or higher). Further, when the document density lies in a range between B and C (where B and C are exclusive), the light emission amount of the lamp 42 is in proportion to the document density.

On the other hand, the surface potential of the drum 7 is set at a fixed value V1 when the document density lies in the range between B and C (where B and C are exclusive). The surface potential of the drum 7 changes according to the document density when the document density is not higher than B or not lower than C. The surface potential of the drum 7 is inversely related to the document density.

More specifically, when an image of a document whose density is higher than B and lower than C is to be copied, the image density is controlled by changing the light emission amount of the lamp 42. On the other hand, when an image of a document whose density is not higher than B or not lower than C is to be copied, the image density is controlled by changing the surface potential of the drum 7.

Figure 4:
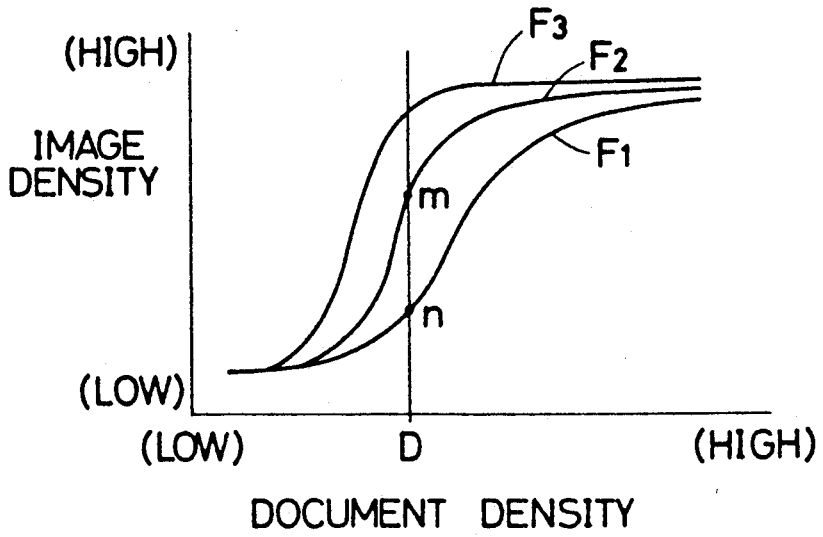
FIG. 4 is a graph showing the relationship between the document density and the image density.
Figure 5:
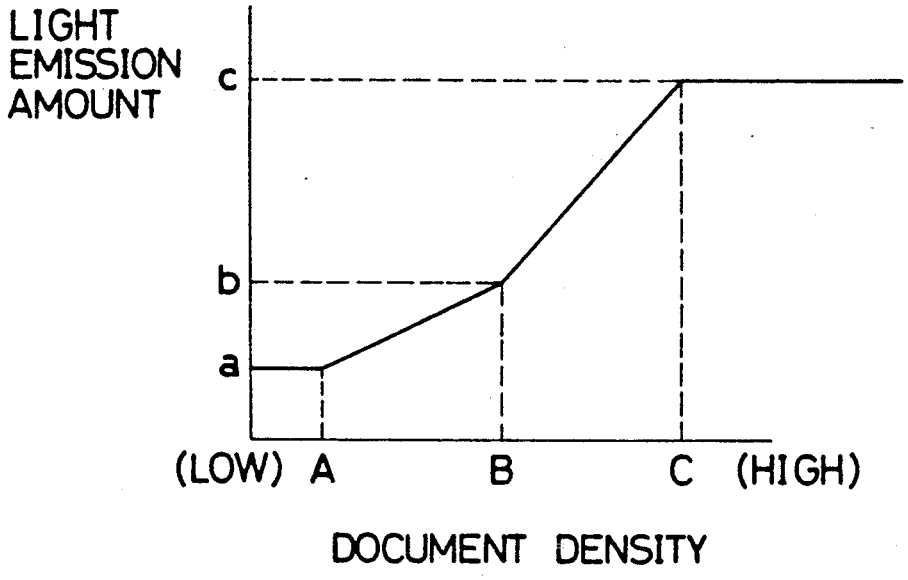
FIG. 5 is a graph showing the relationship between the document density and the image density in an conventional image density control device.

FIG. 4 shows relationship between the document density and the image density wherein the surface potential of the photosensitive drum 7 is used as a parameter. In FIG. 4, curves F1, F2, F3 represents the relationship in states where the surface potential of the drum 7 is set at f1, f2, f3 ($f1<f2<f3$) respectively.

As will be seen from FIG. 4, when the surface potential of the drum 7 is set at a high level, the image density changes abruptly relative to a change in the document density. In other words, the image density becomes more sensitive to the document density. Thus, contrast of the image formed on the copy paper can be made higher for the document whose density is low by increasing the surface potential of the drum 7.

More specifically, when a document having a density D is to be copied, for example, the image density rises from n to m if the surface potential of the drum 7 is increased from f1 to f2. As a result, the contrast of the formed image increases as much as the overall image density becomes high. Conversely, if the surface potential of the drum 7 is reduced from f2 to f1, the image density falls from m to n, and thereby the overall image density becomes low.

Accordingly, when a document whose density is B or lower is to be copied, the light emission amount of the lamp 42 is set at the fixed value L1 corresponding to the reference document G2 regardless of the low document density, thereby preventing the fog density from increasing to a level higher than necessary by making the overall image density lower. On the contrary, the surface potential of the drum 7 is increased as the document density becomes lower, thereby making the contrast of the formed image higher. Therefore, it is made possible to form clear images from characters typed lightly or with thin lines, which would otherwise be copied as unclear images.

In this case, it may be appropriate that the light emission amount of the lamp 42 be smoothly reduced according to a decrease in the document density as represented by a two-dot-chain line in FIG. 3 instead of being set at the fixed value L1. The reference value for controlling the image density is not limited to B, but can be set at any desired reference value.

On the contrary, when a document whose density is C or higher is to be copied, the amount of light projected onto the document is set at the fixed value L2 corresponding to the reference document G3 regardless of the high document density, and therefore the amount of light is deficient relative to the document density. However, if the surface potential of the photosensitive drum 7 is reduced as set forth above, the overall image density becomes low. In view of this, the surface potential of the drum 7 is reduced as the document density becomes higher, enabling the overall image density to be sufficiently low. Thus, it is made possible to form an image at a desired image density without causing the fog density to increase to a level higher than necessary.

In this case, it may be appropriate that the light emission amount of the lamp 42 be smoothly increased according to an increase in the document density as represented by another two-dot-chain line in FIG. 3 instead of being set at the fixed value L2.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image density control device for use in an image forming apparatus having an exposure lamp for emitting light to illuminate a document, a photoreceptor for receiving light reflected from the document to produce an electrostatic latent image, and a charger for charging the photoreceptor, the device comprising:

detector means for detecting a density of the document;

light emission amount controlling means for controlling the amount of light emitted from the exposure lamp;

surface potential controlling means for controlling the charger to change the surface potential of the photoreceptor; and control means responsive to the detector means for controlling, when the document density is in a first predetermined range, the light emission amount controlling means and the surface potential controlling means so as to change the emitted light amount as a first function of the document density change and so as to change the surface potential of the photoreceptor as a second function of the document density change, and controlling, when the document density is in a second predetermined range, the light emission amount controlling means and the surface potential controlling means so as to change the emitted light amount as a third function of the document density change and so as to change the surface potential of the photoreceptor as a fourth function of the document density change.

2. An image density control device as defined in claim 1 wherein the first predetermined range is a range defined by a minimum document density and a predetermined reference document density, and the surface potential controlling means is controlled so as to increase the surface potential in accordance with a decrease in the document density and the light emission amount controlling means is controlled so as to hold the light emission amount at a fixed value when the document density is in the first predetermined range.

3. An image density control device as defined in claim 1 wherein the first predetermined range is a range defined by a predetermined reference document density and a maximum document density, and the surface potential controlling means is controlled so as to decrease the surface potential in accordance with an increase in the document density and the light emission amount controlling means is controlled so as to hold the light emission amount at a fixed value when the document density is in the first predetermined range.

4. An image density control device as defined in claim 1 wherein the first predetermined range includes a first subrange defined by a minimum document density and a first predetermined reference document density and a second subrange defined by a second predetermined reference document density and a maximum document density, the light emission amount controlling means is controlled so as to hold the light emission amount at a first predetermined fixed value while the surface potential controlling means is controlled so as to increase the surface potential in accordance with a decrease in the document density when the detected document density is in the first subrange, the light emission amount controlling means is controlled so as to hold the light emission amount at a second predetermined fixed value while the surface potential controlling means is controlled so as to decrease the surface potential in accordance with an increase in the document density when the document density is in the second subrange.

5. An image density control device as defined in claim 1 wherein the second predetermined range is a range defined by a first predetermined reference document density and a second predetermined reference document density higher than the first predetermined reference document density, and the light emission amount controlling means is controlled so as to increase the light emission amount in accordance with an increase in the document density and the surface potential controlling means is controlled so as to hold the surface potential at a fixed value when the document density is in the second predetermined range.

6. An image density control device as defined in claim 1 wherein the first predetermined range includes a first subrange defined by a minimum document density and a first predetermined reference document density and a second subrange defined by a second predetermined reference document density and a maximum document density, the emission amount controlling means is controlled so as to decrease the emission amount in accordance with a decrease in the document density while the surface potential controlling means is controlled so as to increase the surface potential in accordance with the decrease in the document density when the detected document density is in the first subrange, the emission amount controlling means is controlled so as to increase the emission amount in accordance with an increase in the document density while the surface potential controlling means is controlled so as to decrease the surface potential in accordance with the increase in the document density when the detected document density is in the second subrange.

7. An image density control device as defined in claim 1 wherein said control means comprises a memory for storing the predetermined ranges.

* * * * *